US006718856B2

(12) United States Patent
De Dompierre et al.

(10) Patent No.: US 6,718,856 B2
(45) Date of Patent: Apr. 13, 2004

(54) CONVERTING PRESS

(75) Inventors: Jean-Bernard De Dompierre, Echandens (CH); Ha-Simon Tran, Lausanne (CH); Bernard Jaquet, Rue (CH)

(73) Assignee: Bobst S.A. (CH)

( * ) Notice: Subject to any disclaimer, the term of this patent is extended or adjusted under 35 U.S.C. 154(b) by 31 days.

(21) Appl. No.: 09/855,926

(22) Filed: May 15, 2001

(65) Prior Publication Data

US 2001/0042451 A1 Nov. 22, 2001

(30) Foreign Application Priority Data

May 16, 2000 (CH) ..... 0960/00

(51) Int. Cl.[7] ..... B31B 1/00

(52) U.S. Cl. ..... 83/103; 83/698.11; 493/372; 493/475

(58) Field of Search ..... 83/25, 103, 624, 83/662, 698.11, 698.71, 856; 493/478, 479, 475, 472, 372, 82, 83

(56) References Cited

U.S. PATENT DOCUMENTS

| | | | | | |
|---|---|---|---|---|---|
| 2,456,240 | A | * | 12/1948 | Auer | 493/475 |
| 3,249,272 | A | * | 5/1966 | Scarpa | 493/373 |
| 4,014,232 | A | * | 3/1977 | Mauger | 493/472 |
| 4,175,477 | A | * | 11/1979 | Inose et al. | 493/372 |
| 4,175,686 | A | * | 11/1979 | Lang | 83/103 |
| 4,541,828 | A | * | 9/1985 | Polic | 493/475 |
| 4,913,016 | A | * | 4/1990 | Frei | 83/103 |
| 5,072,507 | A | * | 12/1991 | Meeks | 83/698.71 |
| 5,152,204 | A | * | 10/1992 | Trevizo | 83/698.11 |
| 5,605,527 | A | * | 2/1997 | Gillieron | 493/82 |
| 5,784,939 | A | * | 7/1998 | Rebeaud | 83/698.71 |
| 5,810,233 | A | * | 9/1998 | Varidel | 493/342 |
| 5,893,825 | A | * | 4/1999 | Rebeaud | 493/472 |
| 6,095,962 | A | * | 8/2000 | Rebeaud | 493/373 |
| 6,325,263 | B1 | * | 12/2001 | De Dompierre et al. | 83/620 |
| 6,520,900 | B1 | * | 2/2003 | Sandford | 83/103 |
| 2001/0020767 | A1 | * | 9/2001 | Gombau et al. | 271/245 |
| 2002/0124372 | A1 | * | 9/2002 | Chiari et al. | 29/281.1 |

FOREIGN PATENT DOCUMENTS

| | | |
|---|---|---|
| EP | 0 355 673 | 2/1990 |

* cited by examiner

*Primary Examiner*—Stephen Choi
(74) *Attorney, Agent, or Firm*—Ostrolenk, Faber, Gerb & Soffen, LLP

(57) ABSTRACT

A converting press for paper or cardboard sheets including a waste stripping station and/or a blanking station with a pull-out chase (1, 2, 3, 4). A pair of horizontal transverse rails (5, 11) supports an upper stripping tool for a waste stripping operation, or a blanking tool for a blanking operation. The first rail (5) is fixed relative to the chase and the second rail is movable in a longitudinal direction. The profile of the rails allows receiving and maintaining in an operational waste stripping position, a pull-out chase of an upper tool or an upper stripping board, and/or blanking board for blanking operation.

9 Claims, 3 Drawing Sheets

CONVERTING PRESS

The present invention relates to a converting press for paper or cardboard sheets including a waste stripping station with a tool supporting chase comprising a pair of horizontal transverse rails to which is secured an upper stripping tool.

The present invention also relates to a converting press for paper or cardboard sheets including a blanking station with a tool supporting chase comprising a pair of horizontal transverse rails, to which is secured an upper blanking tool.

The present invention also relates to a converting press for paper or cardboard sheets, including at the same time a waste stripping station and a blanking station such as described above.

The converting presses for paper, solid board or corrugated board are using for each order a whole range of specific converting tools for a specific work. Such a whole range of tools includes specifically:

- a makeready protection plate
- a makeready sheet
- a cutting die
- a cutting plate comprising the cutting counterparts
- a waste upper stripping tool
- a central stripping board
- a lower stripping frame comprising telescopic tools for waste capture
- an upper blanking tool
- a lower blanking tool.

The waste upper stripping tool as well as the upper blanking tool can be a pull-out frame of standard size, whose front and back sides show profiles securing to and sliding onto profiled fastening devices, such as secured transverse rails and interdependent from the reference stations. The terms "longitudinal" and "transverse" when the direction of a body is concerned, "front", "back" and "lateral" when a side of a station is concerned, are used with reference to the way of run of the sheets in the machine. The pull-out frame can include several crossbars, on whose are secured a range of strippers. The locations of the crossbars and the strippers into the pull-out frame are subject to change and have to be defined by the work to be achieved. The fitting up of their location is settled outside the machine, preferably on a presetting table, and is dealing with the preparation of the tool. This operation is relatively tiresome, but is achieved in "masked time" independently from the machine in production.

For short and repetitive orders, an upper tool is often used, called die or upper stripping board, respectively die or upper blanking board, made up of a rectangular wooden board, on which are definitively secured strippers of various shapes, corresponding to this specific work. The wooden die itself is assembled inside a pull-out frame. This frame is then settled into the corresponding station. If necessary, the board must be readjusted in position and reinstalled within the frame.

The whole range of the tools mentioned above must be laid out in an extremely precise way in the various stations of the press at the start up of each work. Particularly in the case of short orders, the productivity of the unit depends on a large scale on the rapidity of the positioning and the setting of the tools.

The aim of the present invention is to make easier and faster the positioning and the setting of the upper strippping tool and/or the upper blanking tool, particularly in the case of short and repetitive orders.

This aim is reached with a kind of a converting press as initially defined by the fact that the stripping station comprises a pair of transverse horizontal rails from whose the first one is fixed compared to the tool supporting chase and the second one is movable in a longitudinal direction, and from which the profiles ensure receiving and maintaining, in an operational waste stripping position, either a pull-out frame of an upper stripping tool or an upper stripping board.

This aim is also reached with a kind of a converting press such as the one previously defined by the fact that the blanking station comprises a pair of transverse horizontal rails from whose the first one is fixed compared to the tool supporting chase and the second one is movable in a longitudinal direction, and from which the profiles ensure receiving and maintaining, in an operational blanking position, either a pull-out frame of an upper blanking tool or an upper blanking board.

A waste stripping station and/or a blanking station, according to the invention, allow overcoming the assembly and setting operations of an upper waste stripping board, respectively of an upper blanking board in a pull-out frame. The boards are directly assembled in the station. Resulting from this is a time saving during the preparation of the press between two operations. It also has as a result a saving in the number of the tooling elements to be used. The fact that the second rail is movable allows the spacing adjusting of the pair of rails to various sizes of boards.

The rails of the station can comprise an upper part whose profile is complementary to the profile of a pull-out frame and a lower part whose profile is complementary to the profile of an upper board, the shaped parts of the two rails facing each other.

The rail located in front of the station preferably presents at the level of the shaped part receiving an upper board, a centering block intended for centering into the machine this upper stripping or blanking board. To deal with possible errors of manufacture of the board, the centering block is preferentially transversely adjustable by a micrometric setting device.

The station includes preferably means allowing a push on the movable rail, longitudinally, into the direction of the fixed rail. Acting so, when the upper tool is settled, it is tightly secured between the fixed rail and the movable rail.

The aforesaid means used to push the movable rail forward to the fixed rail can include at least one spring acting with a permanent pushing on the movable rail into the direction of the fixed rail and at least one cylinder, whose setting into operation by the conductor deletes and overcomes the acting of the spring(s), allowing the loosening and the tools changing.

The movable rail, which is preferably the back one, can be held by at least one support, itself or themselves secured on a moving mean, to be used by the conductor. Thus, the station can deal with upper boards of variable sizes. Furthermore, the movable rail can be carried by two holders secured each one onto a rack with longitudinal moving.

Other characteristics and advantages will be apparent to one skilled in this technical field from the description of a preferred embodiment of the invention, with reference to the drawing in which.

Figure 1:
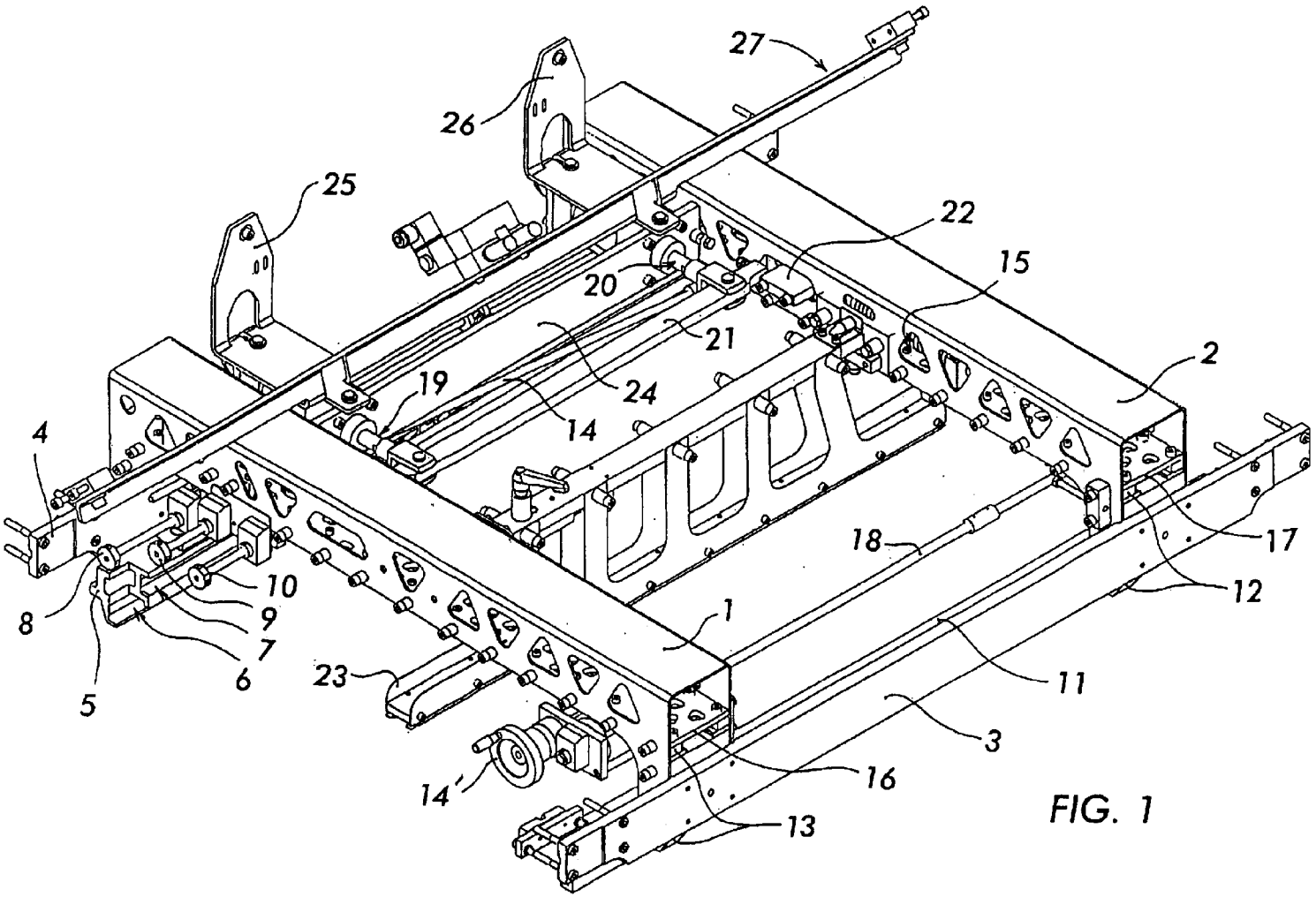
FIG. 1 shows a perspective view of a chase part of a stripping station of a converting press with a pair of rails ensuring the use of an upper stripping tool.

FIG. 1 shows an upper tool supporting chase of a waste stripping station of a converting press with two longitudinal beams 1 and 2 and two transverse beams 3 and 4. One front rail 5, transverse and horizontal, is suspended on the longitudinal beams 1 and 2 by two vertical standards (not shown). Rail 5 shows on its back side two grooves, a lower groove 6 being able to deal with the edge 32 of an upper stripping board 30 and an upper groove 7, into which a rib 36 of a pull-out frame 34 of an universal stripping tool can be slidably mounted. Rail 5 remains normally secured relative to the tool supporting chase, during the operation of the press as well as during the change of tools. However, to overcome slight errors in manufacturing or setting an upper tool, manually controllable devices are intended for the micrometric fitting of the position. Specifically, a knurled knob 8 allows the adjustment of the transverse position of the centering block intended for the centering of an upper board into the machine. Also knurled knobs 9 and 10 act, by means of a rod 14 and levers, respectively and independently one from the other on the two vertical standards onto which rail 5 is suspended, so as to allow correcting the longitudinal position of this one and/or its angular position. These three micrometric fitting devices are equipped with a display 40, which allows, for repetitive works, storing the setting values in memory.

Figure 2:
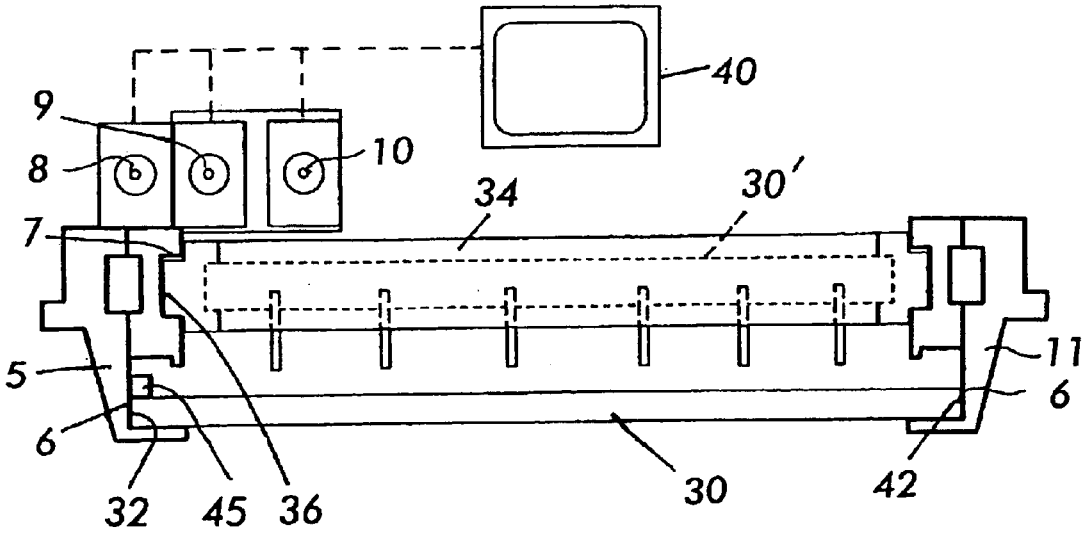
FIG. 2 shows schematically a side view of FIG. 1 from the left.
Figure 3:
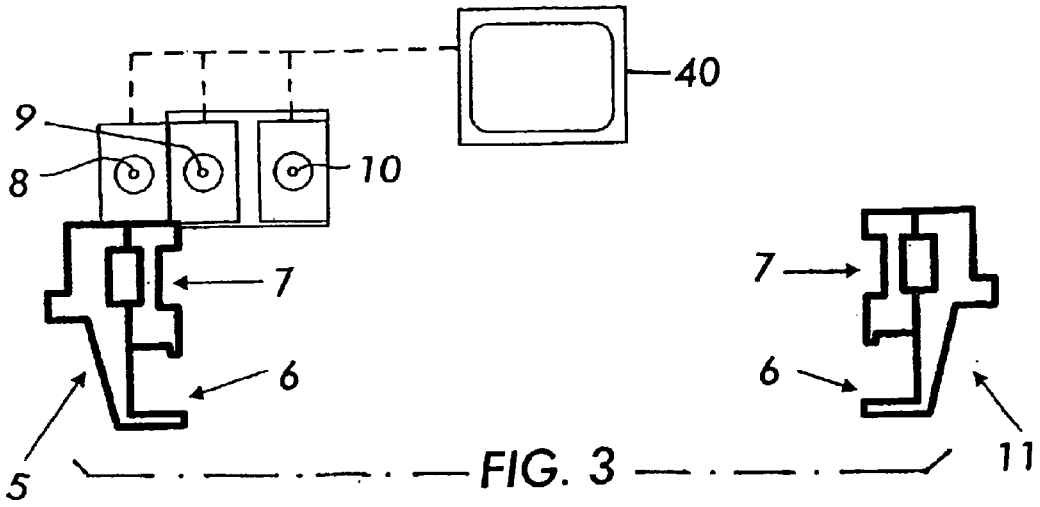
FIG. 3 shows schematically the assembly without stripping tools.
Figure 4:
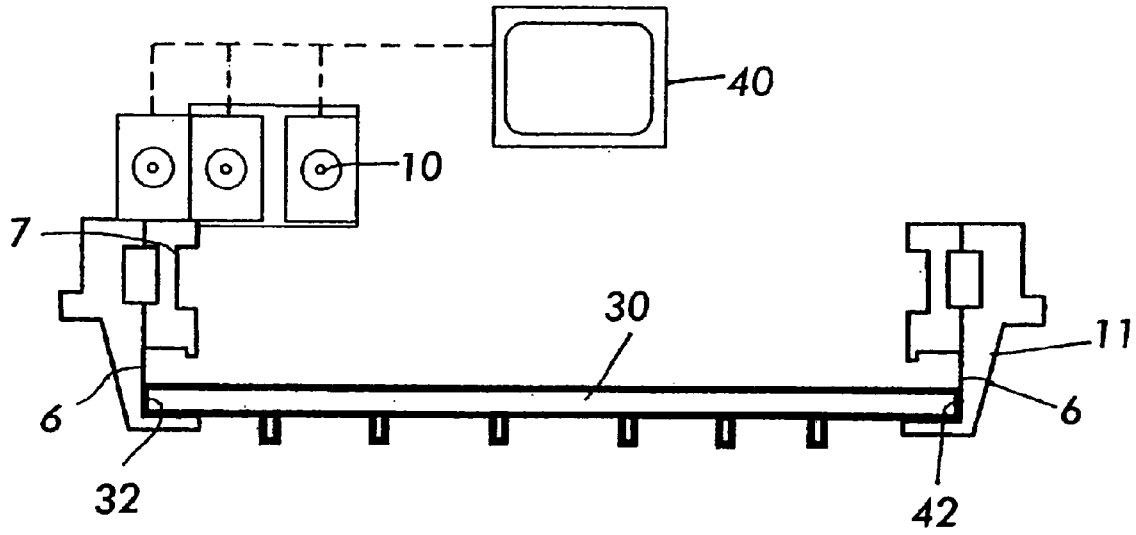
FIG. 4 shows the assembly with a stripping tool.

In front of fixed rail 5 stands a movable back rail 11, parallel to the fixed rail 5. Rail 11 also includes a lower groove 6 for receiving the back edge 42 of an upper stripping board or tool 30 and an upper groove 7 into which a complementary rib of an upper pull-out frame 34 of or containing an universal stripping tool 30' can be slidably mounted. (See FIGS. 2, 4 and 5.)

A centering block 45 at the groove 6 of the rail 5 centers the upper board 30 in the press.

The movable back rail 11 is carried by the vertical legs of two crosswise bearings 12 and 13, whose horizontal legs are supporting toothed wheels, which engage with and can be locked to two longitudinal racks. These racks (not shown) are assembled below two horizontal plates 16 and 17 interdependent of beams 1 and 2, and are londitudinally movable a few millimeters under those plates. A manual control 14', operates the toothed wheels on both sides of the station by means of rod 18. This allows the movable rail 11 to move longitudinally, so as to fit its location to the length of an upper stripping board. A pair of springs under constant pressure, one of which, is shown at 15, are longitudinally secured respective to plates 16 and 17. Each spring, is attached at one end to the respective plate. The other end of each spring engages a block 22, associated with one of the racks. The springs push blocks 22 forward, and thus grip the upper tool between rails 5 and 11.

Figure 5:
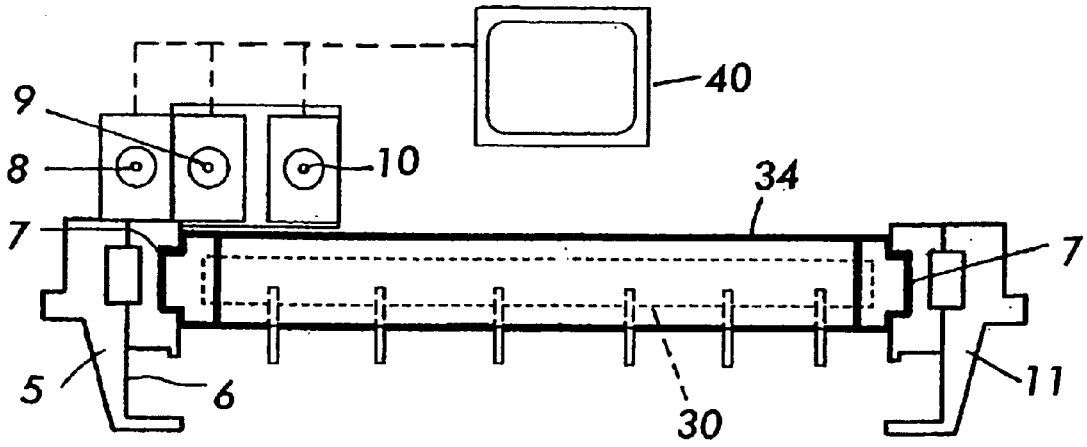
FIG. 5 shows the assembly with a pull-out frame.

Two jacks 19 and 20, secured on a fixed transverse beam 24, secured to the machine frame by two fastening tabs 25 and 26 and by a transverse beam 27, can be put into operation by the user when the frame 34 which is supporting the upper stripping tool 30 is in a high position (FIG. 5). Jacks 19 and 20 are carrying a transverse bar 21. When the tool supporting chase is in the high position, the blocks 22 are at the same level as the edges of the transverse bar 21, 50 that under pressure of the jacks, bar 21 pushes on an extension of blocks 22 passing beyond beams 1 and 2. This overcomes the bias of springs 15 and releases the upper tool, which can be easily removed by the operator.

One can note that bearings 12 and 13 of the movable rail, racks, springs 15 and jacks 19, 20 are symmetrically arranged compared to a vertical plane driving through a longitudinal central axis, so called "axis-machine".

One can also note on FIG. 1 a support beam 23. This beam 23 is movable. It is intended to lead on the top of an upper stripping board 30 so as to maintain the flatness of this latter during the rising and the lowering of the tool supporting chase.

The blanking station is intended to be equipped with the same tool supporting chase.

What is claimed is:

1. A converting press for paper or cardboard sheets comprising:

a waste stripping station including a tool supporting chase; and a pair of horizontal transverse rails including:

a first rail fixed relative to the chase; and a second rail movable in a longitudinal direction relative to the first rail;

each of the first and second rails is shaped with a profile to receive and support in an operational waste stripping position, either of a pull-out frame of having an upper stripping tool or an upper stripping tool; and the profile of the rails comprising each of the rails having a facing side facing the other rail, each facing side of a rail having a first shaped part having a first profile which is complementary to an external profile on a transverse side of the pull-out frame or of the upper stripping tool; and each facing side of a rail having a second shaped part located below the first shaped part and having a second profile which is complementary to the external profile of the upper stripping tool.

2. A converting press according to claim 1, wherein the second shaped part of the first rail comprises a centering block, that centers an upper stripping tool in the second shaped part.

3. A converting press according to claim 2, wherein the tool supporting chase includes a micrometric adjuster for transversely positioning the centering block.

4. A converting press according to claim 3, wherein the micrometric adjuster includes a storable position display.

5. A converting press according to claim 1, wherein the tool supporting chase includes a micrometric adjuster for at least one of longitudinally and angularly positioning the first rail.

6. A converting press according to claim 5, wherein the micrometric adjuster includes a storable position display.

7. A converting press according to claim 1, wherein the chase includes a micrometric adjuster for at least one of longitudinally and angularly positioning the first rail.

8. A converting press according to claim 1, further including a tightening mechanism that maintains the upper stripping tool in an operational position, the tightening mechanism being comprised of at least one spring that biases the second rail in a longitudinal direction towards the first rail and at least one jack operable to counteract the bias imposed by the spring.

9. A converting press according to claim 8, wherein the second rail is movably carried by at least one support, and further including a gearing device linked to the tool supporting chase by an elastic device operable to longitudinally translate the second rail.

* * * * *